United States Patent [19]

Schmid

[11] Patent Number: 4,551,959

[45] Date of Patent: Nov. 12, 1985

[54] BUILDING BLOCK

[76] Inventor: Donald T. Schmid, 10835 Park Ave., Clarence, N.Y. 14031

[21] Appl. No.: 543,175

[22] Filed: Oct. 19, 1983

[51] Int. Cl.[4] ..... E04C 1/00

[52] U.S. Cl. ..... 52/309.12; 52/405

[58] Field of Search ..... 52/309.12, 405, 430, 52/429, 569, 570, 612

[56] References Cited

U.S. PATENT DOCUMENTS

| | | | |
|---|---|---|---|
| 3,817,013 | 6/1974 | Selby | 52/570 X |
| 4,185,434 | 1/1980 | Jones | 52/405 |
| 4,380,887 | 4/1983 | Lee | 52/405 |
| 4,483,115 | 11/1984 | Schoenfelder | 52/405 X |

FOREIGN PATENT DOCUMENTS

| | | | |
|---|---|---|---|
| 341611 | 7/1936 | Italy | 52/430 |
| 545610 | 6/1942 | United Kingdom | 52/570 |

*Primary Examiner*—Carl D. Friedman

*Attorney, Agent, or Firm*—Christel, Bean & Linihan

[57] ABSTRACT

In a building block having two spaced supportive parts separated from one another by a quantity of insulating material positioned between the parts, the block supportive parts and insulating material engage one another over relatively large areas so that the engagement therebetween contributes effectively to the structural integrity of the block as a unit. The block insulating material is exposed at such locations around the block that when the block is installed in a block wall construction, the exposed locations are hidden from view by adjacent blocks.

9 Claims, 3 Drawing Figures

BUILDING BLOCK

BACKGROUND OF THE INVENTION

This invention relates generally to a building block and deals more particularly with a building block having advantageous insulating properties.

It is known that in order to minimize the thermal conductivity between two sidewalls of a building block, the block can be constructed with a quantity of insulating material positioned between its two sidewalls. One such block described in U.S. Pat. No. 4,185,434 includes two parts which are spaced from one another so as to define a continuous gap therebetween and a quantity of insulating material disposed between its two parts. The block has two opposite planar ends, and the gap between its two parts extends between the two ends.

A limitation associated with a conventional block such as is described in the referenced patent relates to the structural integrity of the block as a unit. It is not uncommon that prior to installation of such a block at a job site, the building block is exposed to stresses which can separate a block part from the remainder of the block before the block is installed. Such stresses can result from rough shipment of the block from job to job, rough handling at a job site or simply dropping the block on one of its corners. If, of course, the block separates, the block is no longer comprised of a single unit.

Another limitation associated with a conventional block as is described in the referenced patent relates to its appearance at a corner in a wall construction. Because the gap between the two block parts extends between the two block ends, the insulating material disposed between the parts is exposed to view at each of the block ends. Thus, if a block is used at a corner in a wall construction so that one of its ends is viewable, the exposed insulating material can present an appearance problem.

Still another limitation with a conventional block such as described in the referenced patent relates to mortar joint spacing between adjacent blocks in a wall construction comprised of such blocks. If a mortar joint is used to join adjacent blocks in a wall construction, the blocks are spaced apart a distance equal to the thickness of the mortar joint. Thus, in a wall construction comprised of blocks as is described in the referenced patent and joined together with mortar, the insulating material of the blocks does not provide a continuous barrier of insulation through the wall and the thermal conductivity between the sides of the wall as measured through the mortar joints can be appreciably higher than that as measured through a block.

It is accordingly an object of the present invention to provide an improved building block including two parts which are isolated from one another by a quantity of insulating material and whose structural integrity as a unit is sound.

Another object of the present invention is to provide such a building block wherein its insulating material is hidden from view in a wall construction having a corner.

Still another object of the present invention is to provide such a building block which, when used in a wall construction comprised of like blocks and mortar joints positioned between the blocks, provides an efficient thermal barrier through the mortar joints.

Yet still another object of the present invention is to provide such a building block which is economical and relatively easy to manufacture.

A further object of the present invention is to provide such a building block which doubles as an efficient thermal barrier and an efficient fire barrier.

SUMMARY OF THE INVENTION

This invention resides in an improved building block for use in wall applications in which it is desired that the thermal conductivity between the sides of the wall be low.

The building block is comprised of two spaced block parts and an insulating portion positioned within and substantially filling the space between the two block parts. Each of the two block parts has an inner surface which defines a side of the space between the two parts. In one embodiment of the block, each of its inner surfaces is in engagement with the insulating portion in such a manner that the engagement therebetween contributes effectively to the structural integrity of the block as a unit.

In another embodiment of the block, its insulating portion is exposed at such locations around the block that when this block embodiment is used in selected locations in a wall construction, the insulating portion is hidden from view by other blocks in the wall which are positioned adjacent the block.

In still another embodiment of the block, its insulating portion extends slightly beyond the confines of the space between its block parts so that when this block embodiment is used in a wall in which adjacent blocks of like construction are joined with mortar, its insulating portion engages the insulating portions of an adjacent block and provides, with the insulating portion of adjacent blocks, a continuous barrier of insulation through the wall.

DETAILED DESCRIPTION OF AN ILLUSTRATIVE EMBODIMENT

Figure 1:
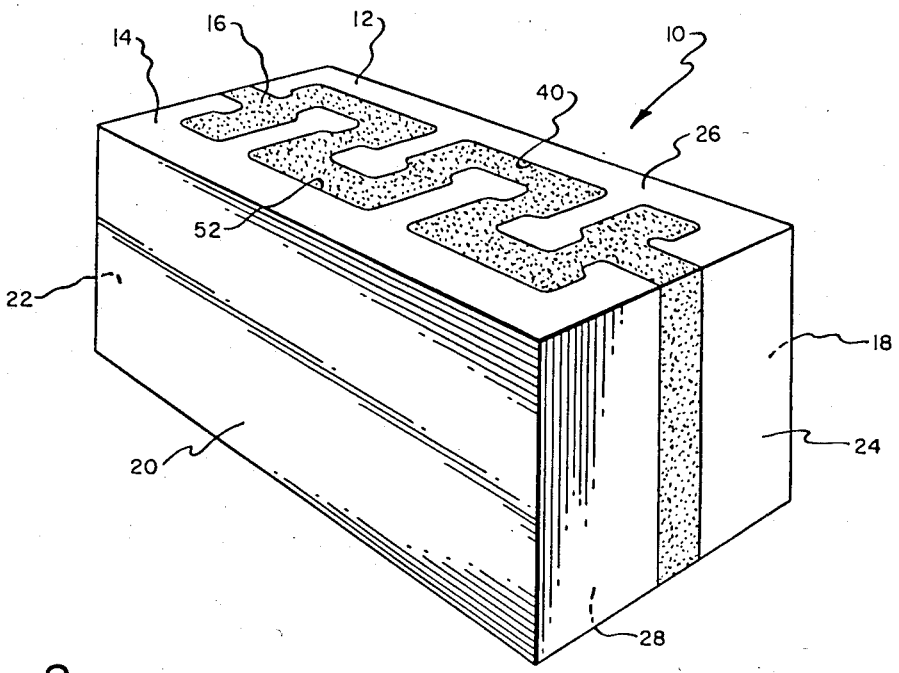
FIG. 1 is a perspective view of an embodiment of a building block in accordance with the present invention.
Figure 2:
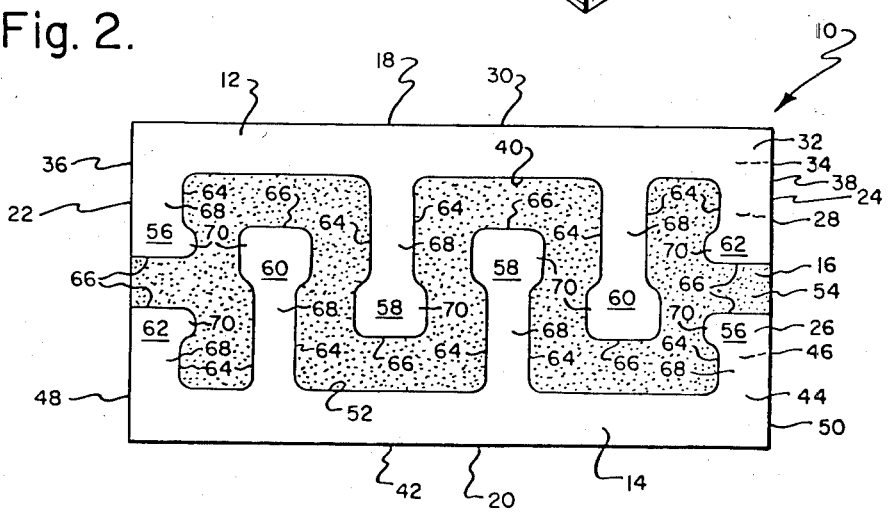
FIG. 2 is a plan view of the building block of FIG. 1.

Turning now to the drawings in greater detail, there is shown in FIGS. 1 and 2 a building block, generally indicated 10, in accordance with the present invention. The building block 10 is comprised of two outer supportive parts 12, 14 and an inner insulating portion 16. The outer portions 12,14 are isolated from one another by the insulating portion 16, and the supportive parts and insulating portion cooperate with one another in a manner hereinafter described that the structural integrity of the block 10 as a unit is sound.

The block 10 is adapted for use in a wall comprised of like blocks in which it is desired that the thermal conductivity between opposite sides of the wall be low. Although the block 10 is particularly well-suited for use in a load-bearing wall for reasons hereinafter set forth, it will be understood that an embodiment of a block in accordance with this invention can be used in a nonload-bearing wall, such as a nonload-bearing building facade. Accordingly, the term "block" as used in the context of this specification is intended to include modular panels.

The block 10 has two opposite planar sidewalls 18,20, two opposite planar ends 22,24, a planar top 26 and a planar bottom 28. The block sidewalls 18 and 20 are parallel to one another, the block ends 22 and 24 are parallel to one another and the block top 26 and bottom 28 are parallel to one another. The block sidewalls 18 and 20 are substantially perpendicular to the block top 26 and bottom 28 and ends 22 and 24, and the block top 26 and bottom 28 are substantially perpendicular to the block ends 22 and 24. When resting upon its bottom 28, the block parts 12 and 14 are vertically disposed and horizontally spaced.

The outer supportive parts 12 and 14 of the block 10 are comprised of a suitable material such as, for example, any cementitious material or baked clay adapted to support a compressive load. With reference to FIG. 2, one outer part 12 defines a planar side surface 30, a planar top surface 32, a planar bottom surface 34, two opposite planar end surfaces 36,38 and an inner surface 40. The side surface 30 of the block part 12 provides the sidewall 18 of the block 10. The part top surface 32 and bottom surface 34 are parallel to one another and substantially perpendicular to the side surface 30, and the part end surfaces 36 and 38 are parallel to one another and substantially perpendicular to the side surface 30 and top and bottom surfaces 32 and 34, respectively.

The other outer part 14 is substantially the same in size and configuration as the outer part 12 and defines a planar side surface 42, a planar top surface 44, a planar bottom surface 46, two opposite planar end surfaces 48 and 50 and an inner surface 52, as shown. The part side surface 42 provides the sidewall 20 of the block 10.

The insulating portion 16 is comprised of a quantity of insulating material 54. The insulating material 54 can be any of a number of suitable materials such as urea or phenol formaldehyde, polystyrene, phenolic resins or polyurethane foam. Preferably, however, in order that the block parts 12 and 14 be assembled quickly to form the block 10, the insulating material 54 is a type of foam-in-place insulation such as polyurethane foam. Thus, to assemble the block 10 with foam-in-place insulation, the block parts 12 and 14 are initially arranged in their desired spaced relation relative to one another and subsequently held in such relation while the insulating material, in its uncured condition, is directed into the space between the block parts 12 and 14. After filling the space with the foam insulation and allowing it to cure to a hardened condition, any excess insulation can be cut or trimmed away as desired.

In accordance with the present invention, the inner surfaces 40 and 52 of the block parts 12 and 14, respectively, and the surfaces of the insulating portion 16 which are in engagement cooperate in such a manner that the engagement therebetween contributes effectively to the structural integrity of the block 10 as a unit. In particular, the insulating portion 16 and the part inner surface 40 engage one another over a relatively large area, and the insulating portion 16 and the part inner surface 52 engage one another over a relatively large area. The aforesaid areas of engagement provide much surface-to-surface contact between the inner surfaces 40 and 52 and insulating portion 16.

Forces which tend to separate the block parts 12 or 14 from the remainder of the block 10 commonly tend to force one of the inner surfaces 40 or 52 to slide relative to the surface of the insulating portion which it engages. It is believed that the large amount of surface-to-surface contact between the block parts and the insulating portion provides a great deal of frictional resistance to such relative sliding movement and that the structural integrity of a block as a unit is thereby enhanced. Thus, the block 10 resists stresses, such as can occur when the block 10 is dropped on one of its corners, which tend to separate one of the block parts 12 or 14 from the remainder of the block 10.

The inner surface 40 of the block part 12 is defined in part by a plurality of projections 56,58,60 and 62 extending from the side of the part 12 opposite its side surface 30. The projecting portions are uniform in cross-section from the top surface 32 of the part 12 to its bottom surface 34 so that the block part 12 is symmetrical about a horizontal midplane or a plane drawn through the part 12 parallel to and equidistant from the part top surface 32 and bottom surface 34. Each projecting portion 56,58,60, or 62 defines at least one surface, indicated 64, which is substantially perpendicular to the block sidewall 18 and another surface, indicated 66, which is substantially parallel to the block sidewall 18. As seen in FIG. 2, each of the projections is comprised of a neck portion, indicated 68, and an enlarged portion 70 at one end of the neck portion 68. As will be described hereinafter, the enlarged portions 70,70 interlock the block part 12 with the insulating portion 16 to help hold the block part 12 and insulating portion 16 together.

It will be noted that corners defined by the projections 56,58,60 and 62 of the block part 12 are rounded. It is believed that such rounded corners are easier to cast in a mold than are sharp corners. Since a block part corresponding to the block part 12 is commonly formed or molded in a cast, it is believed that these rounded corners enable the block part 12 to be easily and quickly fabricated.

As mentioned earlier, the block part 14 is substantially the same in size and configuration as the block part 12. Accordingly, the portions and surfaces of the block part 14 which correspond to those portions and surfaces of the block part 12 are given the same reference numerals in FIG. 2.

As shown in FIG. 2, the projecting portions 70,70 of the block parts 12 and 14 are of such shape and are so arranged relative to one another that the insulating portion 16 disposed between the block parts 12 and 14 is serpentined in cross-section. Furthermore, since the enlarged portions 70,70 of each part projection 56,58,60 or 62 meshes with or is interlocked with the insulation portion 16, the block parts 12 and 14 are securely interconnected with one another. Such an interconnecting relationship between the block parts 12 and 14 further reduces the likelihood that forces applied to the block and in particular, forces which are directed along a line substantially perpendicular to its sidewalls 18 and 20, will separate either of the block parts 12 or 14 from the remainder of the block 10.

Figure 3:
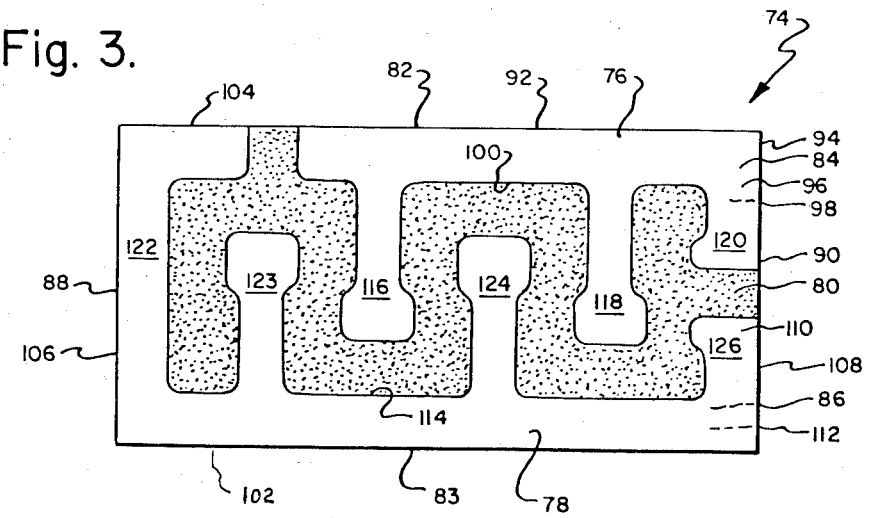
FIG. 3 is a plan view of another embodiment of a building block in accordance with the present invention.

With reference to FIG. 3, there is shown an alternative building block, generally indicated 74, which for a reason hereinafter apparent is particularly well-suited for use at a corner of a wall construction. The block 74 includes a first outer supportive part 76, a second outer supportive part 78 and an insulating portion 80. The block 74 has two opposite planar sidewalls 82 and 83, a planar top 84, a planar bottom 86 and two opposite planar ends 88 and 90. The block sidewalls 82 and 83 are parallel to one another. The block top 84 and bottom 86 are parallel to one another and substantially perpendicular to the sidewalls 82 and 83, and the block ends 88 and 90 are parallel to one another and substantially perpendicular to the block sidewalls 82,83, top 84 and bottom 86.

The first block part 76 defines a planar side surface 92, a planar end surface 94, a planar top surface 96, a planar bottom surface 98 and an inner surface 100. The top and the bottom surfaces 96 and 98 are parallel to one another and are substantially perpendicular to the side surface 92 and end surface 94. The side surface 92 and end surface 94 are substantially perpendicular to one another. The block part 76 includes a plurality of projections 116,118 and 120 as shown, and the inner surface 100 is defined in part by surfaces of these projections.

The second block part 78 of the block 74 defines two opposite planar side surfaces 102 and 104, two opposite planar end surfaces 106 and 108, a planar top surface 110, a planar bottom surface 112 and an inner surface 114. The side surfaces 102 and 104 are parallel to one another, and the end surfaces 106 and 108 are parallel to one another and substantially perpendicular to the side surfaces 102 and 104. The top surface 110 and bottom surface 112 are parallel to one another and substantially perpendicular to the side surfaces 102 and 104 and end surfaces 106 and 108. The block part 78 includes a plurality of projections 122,123,124, and 126 as shown, and the inner surface 114 is defined in part by surfaces of these projections.

The planar sidewall 82 of the block 74 is defined in part by the side surface 92 of the block part 76 and the side surface 104 of the block part 78. The top 84 of the block 74 is defined in part by the top surface 96 of the block part 76 and the top surface 110 of the block part 78. The bottom 86 of the block 74 is defined in part by the bottom surface 98 of the block part 76 and the bottom surface 112 of the block part 78. One end 88 of the block 74 is defined by the end surface 106 of the block part 78, and the other block end 90 is defined in part by the end surface 94 of the block part 76 and the end surface 108 of the block part 78.

In accordance with the present invention, the inner surfaces 100 and 114 of the block parts 76 and 78, respectively, engage the insulating portion 80 in such a manner that the engagement therebetween contributes effectively to the structural integrity of the block 74 as a unit. In particular, the insulating portion 80 and the inner surface 100 of block part 76 engage one another over a relatively large area, and the insulating portion 80 and the inner surface 114 of the block part 78 engage one another over a relatively large area.

Referring again to FIGS. 1 and 2, the insulating portion 16 of the block 10 is exposed to view at only its top 32, bottom 34 and ends 36 and 38. These exposed parts of the insulating portion 16 present no appearance problem if the block 10 is utilized in a block wall so that no more than its sidewalls 18 and 20 are intended as viewable surfaces of a finished wall. On the other hand and with reference to FIG. 3, the insulating portion 80 of the block 74 is exposed to view at only its top 84, bottom 86, one of its ends 90 and one of its sides 82. These exposed parts of the insulating portion present no appearance problem if the block 74 is utilized in a block wall in a manner in which no more than its end 88, its sidewall 83 and a portion, or the right half as viewed in FIG. 3, of its sidewall 82 are intended as viewable surfaces of a finished wall. It follows from the above that the block 10 of FIGS. 1 and 2 is well-suited for use in a straight section of a wall construction in which other blocks in the wall are positioned adjacent its top 26, bottom 28 and ends 22 and 24 so as to cover the insulating portion 16 exposed thereat, and that the block 74 of FIG. 3 is well-suited for use in a corner section of a wall construction in which other blocks in the wall are positioned adjacent its top 84, bottom 86, end 90 and sidewall 82 so as to cover the insulating portion 80 exposed thereat.

It will be understood that numerous modifications can be made to the aforedescribed embodiments without departing from the spirit of the invention. For example, the shapes of the projections of the blocks of FIGS. 1–3 can be modified to either increase or decrease the area of engagement between the outer supportive parts of each block and the corresponding block insulating portions. For purposes of enhancing the structural integrity of a block in accordance with this invention, the greater the area of engagement between a block structural portion and the insulating portion, the better. However, it has been found that in a block having opposite and substantially parallel sidewalls, the structural integrity of a block as a unit is satisfactorily sound if the area of engagement between each of its supportive parts and its insulating portion is at least twice as large as the area of one of its sidewalls.

Furthermore, although each of the insulating portions of the blocks of FIGS. 1–3 have been shown as being level or even with the block surfaces at which the portion is exposed, a block in accordance with this invention can have an insulating portion which extends slightly beyond the confines of the space between its block parts. Such a block construction may be preferred over the blocks of FIGS. 1–3 in a wall construction in which mortar is used to join adjacent blocks in the wall if it is desired that the blocks therein provide a continuous barrier of insulation through the wall. To join such a block with an adjacent block of like construction, mortar is positioned between the block parts of the adjacent blocks and the insulating portions of the adjacent blocks abut one another. Accordingly, the aforedescribed embodiments are intended for purposes of illustration and not as limitation.

I claim:

1. A building block having two opposite and parallel sidewalls and two opposite and parallel ends, said sidewalls and said ends being generally perpendicular to one another, said building block comprising:

two spaced block parts extending along the length of the block sidewalls so that each block part defines at least a portion of a corresponding one of the block sidewalls, each of said parts having an inner surface defining a side of the space between said block parts and including at least three substantially planar projections projecting toward the inner surface of the other of said two parts so that the plane of each projection is oriented substantially parallel to the block ends and so that portions of the inner surfaces of said block parts are defined by the surfaces of said projections, each projection of said block part being spaced from an adjacent projection of its corresponding block part a distance no greater than about one-third the length of each block sidewall and defining an enlarged end portion, said projecting portions of each of said parts being so arranged in relationship to the projecting portions of the other of said parts that the space defined therebetween is generally serpentined in cross section as viewed in a plane oriented perpendicular to the block ends and sidewalls; and an insulating portion positioned within and substantially filling the space between said two block parts so that said enlarged end portions of said projections are in interlocking relationship with said insulating portion and said block parts are thereby securely interconnected with one another, the inner surface of one block part engaging a corresponding surface of an insulating portion over an area which is at least twice as large as the area of the block sidewall defined by said one block part and the inner surface of the other block part engaging a corresponding surface of an insulating portion over an area which is at least twice as large as the area of the block sidewall defined by said other block part so that the engagement between said block parts and said insulation portion contributes effectively to the structural integrity of said block as a unit.

2. A building block as defined in claim 1 wherein each of said projections defines a corner and said corner is rounded.

3. A building block as defined in claim 1 wherein said block parts and insulating portion are symmetrical in cross section about a midplane oriented perpendicular to the block ends and sidewalls.

4. A building block as defined in claim 1 wherein each of said inner surfaces includes a plurality of corners and each of said corners is rounded.

5. A building block as defined in claim 1 wherein said block is rectangular and defines a top and a bottom oriented generally perpendicular to said block ends and sidewalls, said block parts are spaced from one another at one end of said block about a first path oriented generally perpendicular to said block top and bottom and extending through a point on said one block end located generally midway between said block sidewalls, one of said block parts has an enlarged projection located at the end of said block opposite said one block end and extending between the block sidewalls so that said enlarged projection defines said opposite block end and a portion of one of said block sidewalls, the other of said block parts and said enlarged projection being spaced from one another along said one block sidewall about a second path oriented generally perpendicular to said block top and bottom and extending through a point on said one block sidewall located a distance from said opposite block and equal to about one-half the distance between said two block sidewalls, and said insulating portion is exposed around said block only along said first path and said second path so that when a block is used at a corner in a wall construction, the exposed portions of said insulating portion around said block can be hidden from view by blocks in said wall construction positioned in abutting relationship with said one block end and said one block sidewall.

6. A building block as defined in claim 5 wherein said insulating portion is exposed only at said block top, block bottom, one block end and one block sidewall.

7. In a building block having two spaced block parts, an insulating portion disposed between said block parts so as to substantially fill the space therebetween, two opposite and substantially parallel sidewalls, and two opposite and substantially parallel ends oriented substantially perpendicular to said block sidewalls, each of said block parts extending between block ends and defining at least a portion of a corresponding one of said block sidewalls and each part having an inner surface defining a side of the space between said block parts, the improvement comprising:

at least three substantially planar projections defined by each of said block parts and which project toward the inner surface of the other of said block parts so that the plane of each projection is oriented substantially parallel to the block ends, each projection of said block parts being spaced from an adjacent projection of its corresponding block part a distance no greater than about one-third the length of each block sidewall and defining an enlarged end portion, said projecting portions of each of said block parts being arranged in relationship to the projecting portions of the other of said parts so that the space defined therebetween is serpentined in cross section as viewed in a plane oriented perpendicular to said block sidewalls and said block ends and so that the inner surface of one block part engages a corresponding surface of an insulating portion over a first relatively large area and the inner surface of the other block part engages a corresponding surface of an insulating portion over a second relatively large area, said first relatively large area being at least twice as large as the area of the block sidewall defined by said one block part and said second relatively large area being at least twice as large as the area of the block sidewall defined by said other block part.

8. A wall comprised of a plurality of rectangular building blocks, each of said building blocks having two opposite and substantially parallel sidewalls, a top, a bottom and two opposite and substantially parallel ends, two spaced block parts extending between said block ends, each of said parts having an inner surface defining a side of the space between said block parts and including at least three substantially planar projections projecting toward the inner surface of the other of said two block parts so that the plane of each projection is oriented substantially parallel to the block ends and so that portions of the inner surfaces of said block parts are defined by the surfaces of said projections, each projection of said block parts are defined by the surfaces of said projections, each projection of said block part being spaced from an adjacent projection of its corresponding block part a distance no greater than about one-third the length of each block sidewall and defining an enlarged end portion, said projecting portions of each of said parts being so arranged in relationship to the projecting portions of the other of said parts that the space therebetween is serpentined in cross-section as viewed in a plane oriented perpendicular to the block ends and sidewalls, and an insulating portion positioned within and substantially filling the space between said two block parts so that said enlarged end portions of said projections are in interlocking relationship with said insulating position and said block parts are thereby securely interconnected with one another, the inner surface of one block part engaging a corresponding surface of an insulating portion over an area which is at least twice as large as the area of the block sidewall defined by said one block part and the inner surface of the other block part engaging a corresponding surface of an insulating portion over an area which is at least twice as large as the area of the block sidewall defined by said other block parts, said insulating portion of each block being exposed prior to installation in said wall at such locations around said block that when each block is installed in said wall, other blocks in said wall which are positioned adjacent the block hide its exposed insulating portion from view and the insulating portions of each block is generally aligned with the insulating portion of the adjacent blocks.

9. A wall as defined in claim 8 wherein said wall has a straight section and a corner section, each of said blocks in said straight section having its insulating portion exposed prior to installation at only said block top, block bottom, and block ends and each of said blocks in said corner section having its insulating portion exposed prior to installation at only said block top, block bottom, one block end and one block sidewall.

* * * * *